US008888476B2

(12) United States Patent
Hasegawa et al.

(10) Patent No.: US 8,888,476 B2
(45) Date of Patent: Nov. 18, 2014

(54) HORIZONTAL SCROLL COMPRESSOR

(75) Inventors: Shuji Hasegawa, Shizuoka (JP); Mutsunori Matsunaga, Shizuoka (JP); Masashi Miyake, Shizuoka (JP)

(73) Assignee: Hitachi Appliances, Inc., Tokyo (JP)

( * ) Notice: Subject to any disclaimer, the term of this patent is extended or adjusted under 35 U.S.C. 154(b) by 973 days.

(21) Appl. No.: 13/055,152

(22) PCT Filed: Jun. 29, 2009

(86) PCT No.: PCT/JP2009/061829

§ 371 (c)(1),
(2), (4) Date: Jan. 21, 2011

(87) PCT Pub. No.: WO2010/010790

PCT Pub. Date: Jan. 28, 2010

(65) Prior Publication Data

US 2011/0129378 A1 Jun. 2, 2011

(30) Foreign Application Priority Data

Jul. 25, 2008 (JP) ..... 2008-191579

(51) Int. Cl.
*F03C 2/00* (2006.01)
*F04C 2/00* (2006.01)

(Continued)

(52) U.S. Cl.
CPC ..... *F04C 18/0215* (2013.01); *F04C 29/023* (2013.01); *F04C 29/025* (2013.01); *F04C 2250/102* (2013.01); *F04C 23/008* (2013.01); *F04C 29/12* (2013.01); *F04C 2240/806* (2013.01); *F04C 29/026* (2013.01); *Y10S 418/01* (2013.01)
USPC ..... 418/55.6; 418/55.1; 418/88; 418/94; 418/DIG. 1; 184/6.17

(58) Field of Classification Search
CPC .. F04C 18/0215; F04C 23/008; F04C 29/023; F04C 29/025; F04C 29/12; F04C 2240/806; F04C 2240/809; F04C 2250/102; F01C 1/0215; F16N 7/366; F16N 13/22; F16N 25/04
USPC ..... 418/55.1–55.6, 57, 94, 100, 270, 418/DIG. 1; 184/6.16–6.18
See application file for complete search history.

(56) References Cited

U.S. PATENT DOCUMENTS 5,137,437 A * 8/1992 Machida et al. ..... 418/55.1
5,345,785 A 9/1994 Sekigami et al.

(Continued)

FOREIGN PATENT DOCUMENTS

JP 05-126072 5/1993
JP 06066275 A * 3/1994 ..... F04C 18/02

(Continued)

OTHER PUBLICATIONS

Chinese office action of Appln. No. 2008-191579 dated Sep. 11, 2012.

*Primary Examiner* — Theresa Trieu
(74) *Attorney, Agent, or Firm* — Antonelli, Terry, Stout & Krauss, LLP.

(57) ABSTRACT

The inside of a sealed container (50) of a horizontal scroll compressor is partitioned by a partition plate (80) into a space in which a compressor mechanism section and an electric motor are contained and into a discharge space (84) in which a discharge pipe (52) and an oil supply pump (70) are contained. An upper communication path (85) and a path guide member (81) are provided in the upper part of the partition plate, and a refrigerant gas passes through the upper communication path (85). The path guide member is located below the discharge pipe (52), is extended to a position near a side surface of the sealed container, and has a path area greater than the path area of the discharge pipe. The construction causes the refrigerant gas to collide with the side surface of the sealed container, promoting separation of oil, and even if the oil is re-dispersed by a gas flow, the construction reduces flow directly leading to the discharge pipe.

12 Claims, 5 Drawing Sheets

(51) Int. Cl.

| | |
|---|---|
| ***F04C 18/00*** | (2006.01) |
| ***F04C 29/02*** | (2006.01) |
| ***F04C 23/00*** | (2006.01) |
| ***F04C 29/12*** | (2006.01) |
| ***F04C 18/02*** | (2006.01) |

(56) References Cited

U.S. PATENT DOCUMENTS

| | | | | |
|---|---|---|---|---|
| 5,391,066 | A * | 2/1995 | Sawai et al. | 418/55.6 |
| 5,580,233 | A * | 12/1996 | Wakana et al. | 418/94 |
| 6,322,339 | B1 * | 11/2001 | Mitsunaga et al. | 418/55.2 |
| 7,628,593 | B2 | 12/2009 | Takao et al. | |
| 2006/0057010 | A1 * | 3/2006 | Tsubono et al. | 418/55.5 |
| 2008/0008614 | A1 | 1/2008 | Takao et al. | |

FOREIGN PATENT DOCUMENTS

| | | | | |
|---|---|---|---|---|
| JP | 08-312560 | | 11/1996 | |
| JP | 3272311 | | 4/2002 | |
| JP | 2003172276 | A * | 6/2003 | F04C 18/02 |
| JP | 2008-014259 | | 1/2008 | |

* cited by examiner

HORIZONTAL SCROLL COMPRESSOR

TECHNICAL FIELD

The present invention relates to a horizontal scroll compressor which is used as a refrigerant compressor for refrigeration or air-conditioning, and an air or another gas compressor.

BACKGROUND ART

As the conventional horizontal scroll compressor, there is the one described in JP-A-5-126072. The document describes the structure provided with a separation plate which partitions the inside of a sealed container into a part accommodating an electric motor and a compressor mechanism section, and a part including a discharge pipe and an oil sump for supplying oil to a bearing.

Further, JP-A-2008-14259 describes the one which is provided with a support plate which separates a first volume accommodating an electric motor and a compressor mechanism section and a second volume including a discharge pipe, and includes an oil supply pump at a shaft end portion of a drive shaft at the side of the second volume so as to supply a lubricant oil at a lower part of the aforesaid second volume to a bearing of the compressor mechanism section with this oil supply pump.

CITATION LIST

Patent Literatures

Patent Literature 1: JP-A-5-126072
Patent Literature 2: JP-A-2008-14259

SUMMARY OF INVENTION

Technical Problem

In the horizontal scroll compressor including a separation plate which partitions a volume in which an electric motor section and a compressor mechanism section are provided, and a volume in which a discharge pipe is provided, and includes an oil supply pump at a shaft end portion, it is necessary to secure an oil level height for sucking oil from the oil supply pump. For this purpose, it is necessary to reduce a so-called rate of oil circulation (oil floating) which indicates the oil going out into a refrigeration cycle with a refrigerant gas from the discharge pipe. The prior arts each adopt the structure in which the refrigerant gas and oil which are discharged from the compressor mechanism section pass the upper part of the separation plate after passing through the electric motor, and thereafter, flow outside the compressor from the discharge pipe, so that by the pressure loss in front of and behind the separation plate, the oil level height in the volume provided with the discharge pipe is kept high. However, in the volume provided with the discharge pipe, there arises the problem that the oil in the oil sump is re-dispersed by the flow of the discharge gas which passes the upper part of the separation plate, and the oil flows out from the discharge pipe with the refrigerant gas to increase the oil circulation rate in the refrigeration cycle.

Solution to Problem

In order to solve the above described problem, the present invention is a horizontal scroll compressor which accommodates a compressor mechanism section having an orbiting scroll and a fixed scroll with spiral laps upright on base plates, and an electric motor section which rotationally drives the compressor mechanism section in a sealed container, and discharges a gas compressed by the compressor mechanism section from a discharge pipe provided at the sealed container, wherein a partition plate is provided which partitions the sealed container into a volume in the sealed container in which the compressor mechanism section and the electric motor section are disposed, and a discharge volume in the sealed container in which an oil supply pump which supplies oil to a bearing for supporting a drive shaft rotationally driving the compressor mechanism section and the discharge pipe are disposed, and at an upper part of the partition plate, an upper communication path which allows a compressed gas from the compressor mechanism section to pass through is formed, a path guide member which guides the compressed gas from the upper communication path to the vicinity of an inner side surface of the sealed container is provided, and the path guide member is disposed below the discharge pipe.

Here, an end portion at a compressed gas blow-off port side of the path guide member is preferably closer to a side surface of the sealed container than the discharge pipe. Further, the path guide member is preferably configured into an annular shape, and a passage area thereof is preferably configured to be larger than a passage area of the discharge pipe.

A plurality of the upper communication paths can be formed in the partition plate. Here, the path guide member is preferably configured into an annular shape covering the plurality of upper communication paths.

Further, a blow-off pipe extending in an axial direction can be connected to the upper communication path formed in the partition plate, the blow-off pipe can be provided to be extended to the vicinity of the inner side surface of the sealed container, and the path guide member can be located between the blow-off pipe and the discharge pipe and configured into an umbrella shape.

Here, a plurality of the upper communication paths and a plurality of blow-off pipes are provided, and a total communication area of the plurality of blow-off pipes is preferably configured to be larger than a path area of the discharge pipe.

The oil supply pump is preferably configured by a trochoid type pump.

According to the present invention, the configuration is adopted, in which a partition plate is provided which separates a volume in which the compressor mechanism section and the electric motor section are disposed and a discharge volume in which an oil supply pump and the discharge pipe are disposed from each other, and at an upper part of the partition plate, an upper communication path which allows a compressed gas from the compressor mechanism section to pass through is formed, a path guide member which guides the compressed gas from the upper communication path to the vicinity of an inner side surface of the sealed container is provided, and the path guide member is disposed at a lower side from the discharge pipe. Therefore, the oil circulation rate (oil floating) which is the oil going out into the refrigeration cycle from the inside of the compressor can be reduced, and the oil level height in the intake section of the oil supply pump in the compressor can be kept high. Therefore, the effect of being capable of obtaining a horizontal scroll compressor with high reliability is provided.

Other objects, features and advantages of the invention will become apparent from the following description of the embodiments of the invention taken in conjunction with the accompanying drawings.

DESCRIPTION OF EMBODIMENTS

In the present invention, a volume in which a compression mechanism section and an electric motor section are provided, and a volume in which a discharge pipe is disposed are partitioned with a partition plate, an upper communication path and a path guide member continuing to the upper communication path are provided at an upper part of the partition plate, and the path guide member is formed into a shape extended close to a side surface of a sealed container, whereby a refrigerant gas and oil which pass the upper part of the partition plate collide with the side surface of the sealed container, and thereby, the refrigerant gas and the oil are separated. Further, if in the volume in which the discharge pipe is disposed, the aforesaid discharge pipe is mounted to a top part of the sealed container, the aforesaid path guide member provided at the aforesaid partition plate is provided under the discharge pipe, and the passage area of the path guide member is made larger than the discharge pipe passage area, the effect of suppressing the oil from blowing back up in the oil sump by the refrigerant gas flow can be increased.

Hereinafter, concrete embodiments of a horizontal scroll compressor of the present invention will be described based on the drawings.

Embodiment 1

Figure 1:
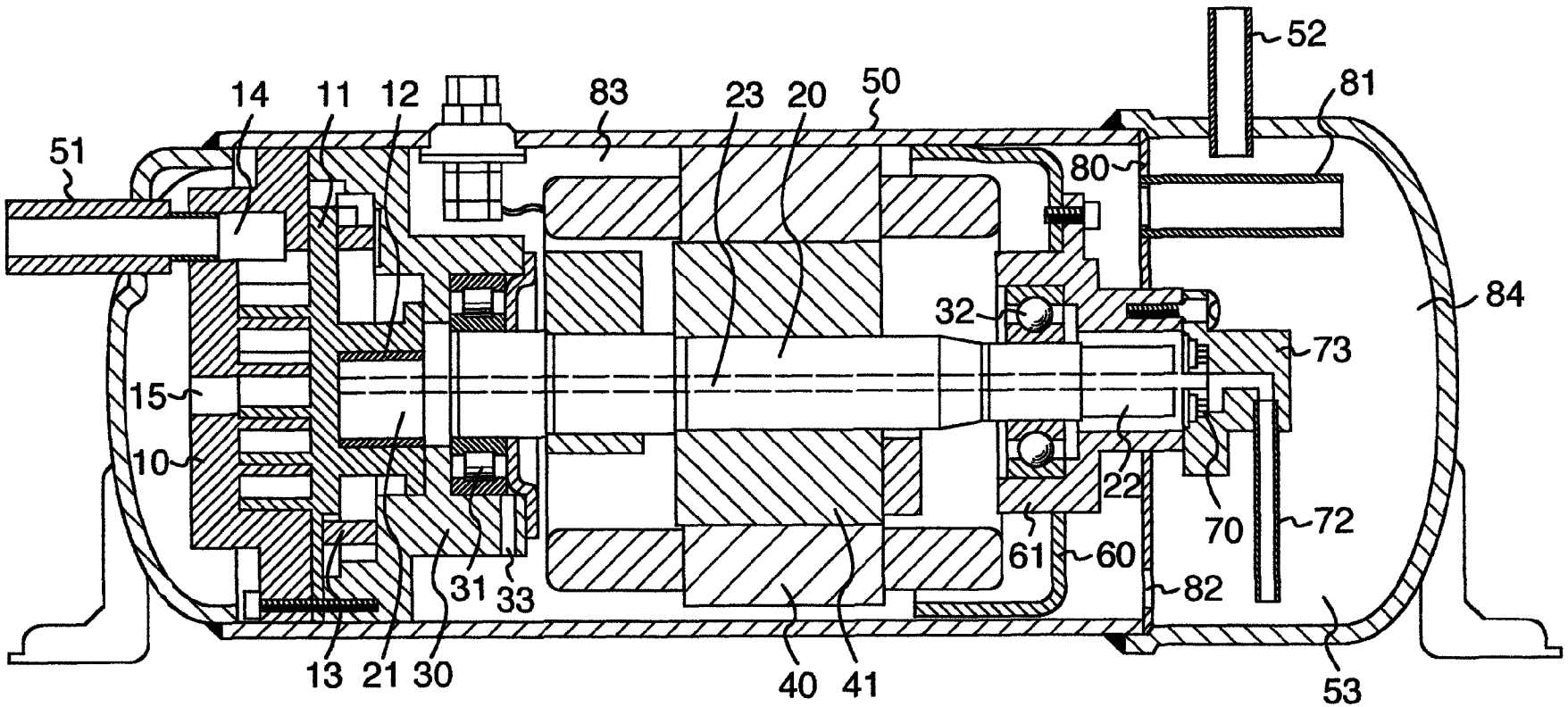
FIG. 1 is a vertical sectional view of a horizontal scroll compressor of embodiment 1 of the present invention.

FIG. 1 is a sectional view of a horizontal scroll compressor of the present embodiment. In a sealed container 50 configuring the scroll compressor, a compressor mechanism section, an electric motor section, a drive shaft (crankshaft) 20, an oil supply pump 70, an oil sump 53 and the like are accommodated. Further, an intake pipe 51 and a discharge pipe 52 are attached to the sealed container 50. An inside of the sealed container is partitioned by a partition plate 80 into a middle volume 83 in which the aforesaid compressor mechanism section and electric motor section are placed, and a discharge volume 84 in which the aforesaid discharge pipe 52 and the like are placed.

The aforesaid compressor mechanism section is configured by causing a fixed scroll 10 and a orbiting scroll 11 which have spiral laps to be meshed with each other. A boss is projectingly provided at a side opposite from the lap of the orbiting scroll 11 so as to have a structure which slides with a crank pin 21 of the aforesaid drive shaft 20 via an orbiting bearing 12. Further, at the side opposite from the lap of the aforesaid orbiting scroll 11, an Oldham coupling 13 is also placed. The Oldham coupling 13 is a coupling as a rotation on its own axis prevention mechanism which makes the orbiting scroll 11 perform revolving movement without rotating on its axis with respect to the fixed scroll 10.

In the above described compression mechanism section, when the crank pin 21 is eccentrically rotated by the rotation of the aforesaid drive shaft 20 connected to a rotor 41 of the electric motor section, the orbiting scroll 11 performs revolving movement without rotating on its own axis with respect to the fixed scroll 10 by the rotation on its own axis prevention mechanism of the Oldham coupling 13, and, for example, a refrigerant gas is sucked into a sealed volume formed by the laps of the fixed scroll 10 and the orbiting scroll 11 through the intake pipe 51 and an intake port 14. By the above described orbiting movement, the sealed volume decreases the capacity while moving to the central part, and thereby, compresses the refrigerant gas, and discharges the compressed gas from a discharge port 15. The discharged refrigerant gas passes the peripheries of the compressor mechanism section and the electric motor section, and thereafter, is discharged outside the compressor from the discharge pipe 52.

The drive shaft 20 is supported by a main bearing 31 and an auxiliary bearing 32, and the main bearing 31 is fitted in a frame 30 fixed to the sealed container. The auxiliary bearing 32 is located at an opposite side from the compressor mechanism section with a stator 40 of the electric motor therebetween, and is fitted in a housing 61 which is fixed to the sealed container 50 via a lower frame 60. A pump coupling 22 is attached to a shaft end portion at a side of the drive shaft 20, which is opposite from the compressor mechanism section side, and the oil supply pump 70 is driven via the pump coupling 22. As the oil supply pump 70, a trochoid pump is used. An oil supply pipe 72 which is opened in the lower part of the sealed container to form an oil supply path is attached to a pump case 73 of the oil supply pump 70.

When the drive shaft 20 is rotated, a lubricant oil is sucked from the oil sump 53 at the lower part of the discharge volume 84 through the oil supply pipe 72 of the oil supply pump 70, and through an oil path 23 which is formed in a center of the crankshaft 20, part of the sucked oil is supplied to the auxiliary bearing 32, and the remaining oil is supplied to the orbiting bearing 12 and the main bearing 31. The oil supplied to the orbiting bearing 12 and the main bearing 31 is discharged to the lower part of the sealed container 50 from an oil discharge path 33 provided in the frame 30.

Next, the flow of the refrigerant gas which is discharged from the discharge port 15 of the fixed scroll 10 will be described. The gas which is compressed in the scroll laps is discharged in an axial direction from the discharge port 15 of the fixed scroll 10, and collides with a side surface of the sealed container 50 at the side of the discharge port 15. Thereby, the first separation of the oil included in the refrigerant gas is performed, and the separated oil accumulates in the lower part of the volume at the side of the discharge port 15 of the sealed container 50, and the oil which accumulates in the volume flows out to the volume formed under of the electric motor through a gap (not illustrated) formed between the lower parts of the fixed scroll 10 and the frame 30, and the sealed container. A gap is formed below the stator 40 of the electric motor, and the oil is configured to be able to flow out to the discharge volume 84 side further through a communication hole provided below the aforesaid lower frame, a lower communication path 82 formed in the aforesaid partition plate 80 and the like.

Meanwhile, the refrigerant gas which is discharged from the discharge port 15 flows into the middle volume 83 in which the electric motor section is provided, through an upper gap (not illustrated) between the fixed scroll 10 and the frame 30, and the sealed container 50. The middle volume 83 and the aforesaid discharge volume 84 are caused to communicate with each other through an upper communication path 85 and a path guide member 81 which are formed in the upper part of the aforesaid partition plate 80. The compressed refrigerant gas collides with a side surface of the sealed container in the discharge volume 84 from the aforesaid path guide member 81. By the collision, the second separation of the refrigerant gas and the oil is performed, and thereafter, the refrigerant gas from which the oil is separated is discharged outside the compressor from the discharge pipe 52 which is disposed at the discharge volume 84 side.

Figure 2:
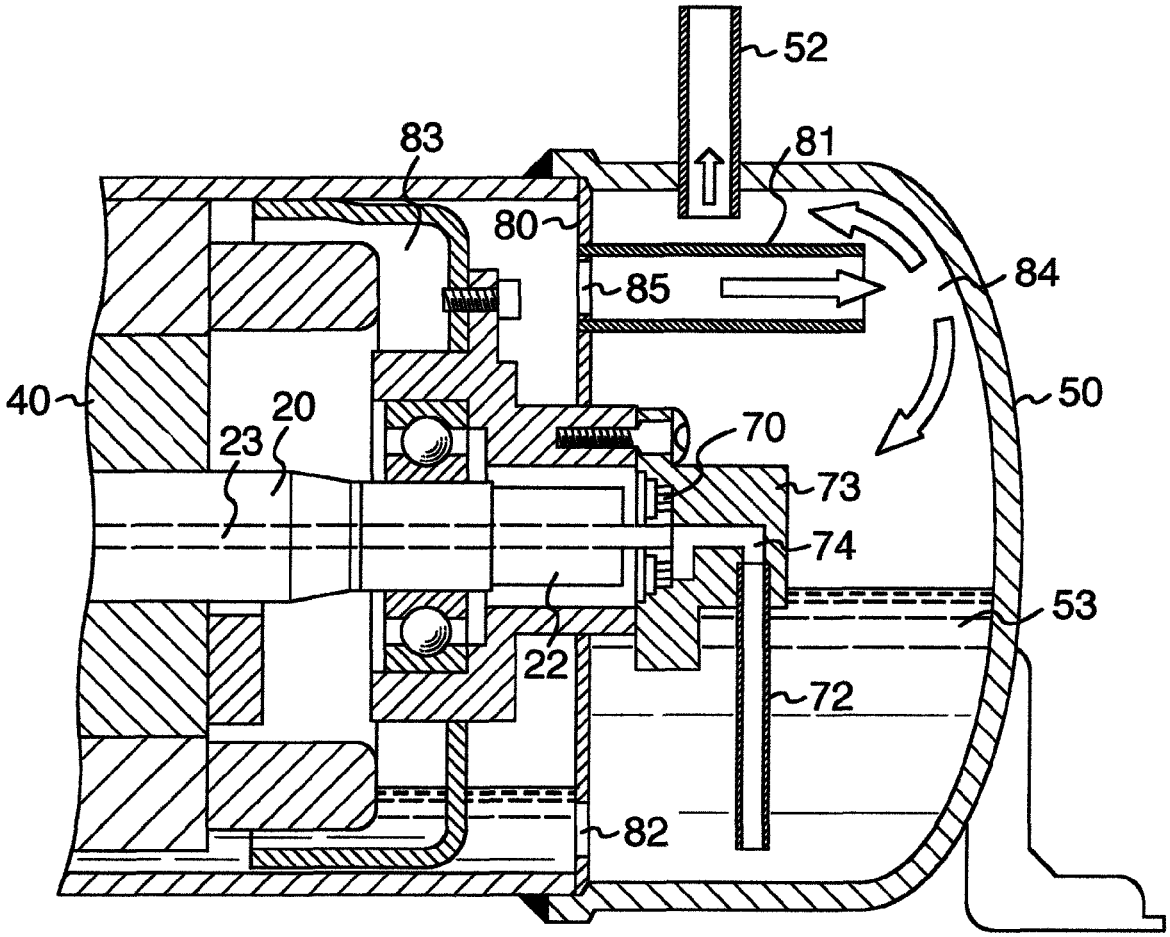
FIG. 2 is a vertical sectional view showing in detail a configuration of a discharge volume 84 side in a sealed container in the horizontal scroll compressor shown in FIG. 1.
Figure 3:
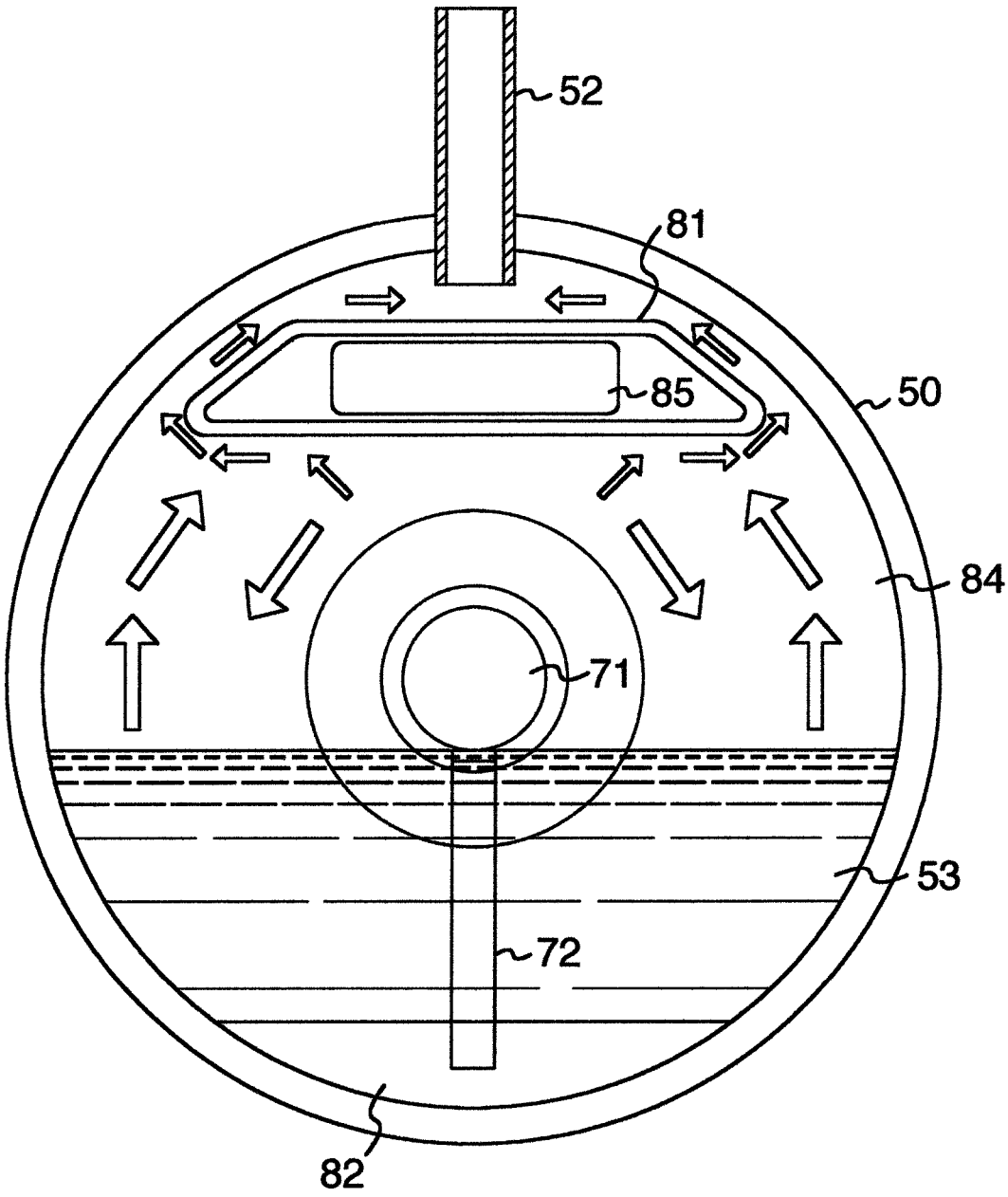
FIG. 3 is a cross-sectional view of an inside of the discharge volume 84 shown in FIG. 2, seen from an opposite side of a compression mechanism section.

The structure of the present embodiment will be described in more detail with use of FIGS. 2 and 3. FIG. 2 is a vertical sectional view showing in detail the configuration at the discharge volume 84 side in the sealed container, and FIG. 3 is a cross-sectional view of the inside of the discharge volume 84 shown in FIG. 2, which is seen from the opposite side of the compressor mechanism section.

The partition plate 80 is fixed to the sealed container 50, and the partition plate 80 is provided with the upper communication path 85 which allows the compressed refrigerant gas to pass through and the lower communication path 82 through which the oil passes. Further, the path guide member 81 is attached to the partition plate 80 so as to communicate with the upper communication path 85. The partition plate 80 and the path guide member 81 are configured by a thin press metal plate. The aforesaid partition plate 80 and the path guide member 81 may be produced as press metal plate products respectively as separate components, and may be formed as an integrated component by welding or the like.

The oil supply pump 70 is placed in the discharge volume 84, and sucks the oil accumulating in the oil sump 53 in the lower part of the discharge volume 84 through the oil supply pipe 72, and after the oil passes through a path 74 in the pump case 73, the oil supply pump 70 supplies the oil to each of the bearings through the oil path 23 formed in the center of the crankshaft 20.

The path guide member 81 which is provided in the upper part of the partition plate is provided to be extended closer to the side surface of the sealed container at the side opposite from the compressor mechanism section than the position of the discharge pipe 52 attached to the sealed container, and is configured to be able to cause the refrigerant gas blown from the upper communication path 85 in the partition plate to collide with the side surface of the sealed container efficiently. More specifically, by causing the refrigerant gas in which oil is included to collide with the side surface of the sealed container reliably, separation of oil can be promoted. In the conventional compressor, the refrigerant gas blown out to the discharge volume from the upper communication path of the partition plate directly flows into the discharge pipe 52, and there arises the problem that separation of oil is not sufficiently performed, and oil floating increases. Further, in the discharge volume 84, the gas blown out from the upper part of the partition plate re-disperses the oil in the oil sump 53 in the discharge volume 84 by the gas flow to be the factor of increasing oil floating. In contrast with this, in the present embodiment, the discharge pipe 52 is disposed at the upper side of the path guide member 81 provided in the upper part of the partition plate, and the path area of the path guide member 81 is configured to be larger than the path area of the discharge pipe 52. Thereby, even if the oil is re-dispersed by the gas flow in the discharge volume, the presence of the path guide member 81 reduces the flow directly leading to the discharge pipe 52, and the oil circulation rate, which indicates the oil going outside the compressor, can be reduced. Accordingly, the oil level height of the oil sump in the discharge volume can be kept high, and oil supply with the oil supply pump 70 can be reliably performed.

FIG. 2 shows the state in which the refrigerant gas is blown out of the path guide member 81 in the upper part of the partition plate, and collides with the side surface of the sealed container 50, where oil separation is performed, and the refrigerant gas subjected to oil separation flows to the discharge pipe 52 by the directions of the arrows. FIG. 3 shows the flow of the refrigerant gas blown out of the path guide member 81 in the discharge volume 84 by the arrows. In the present embodiment, the path guide member 81 is formed into a ring shape by a thin plate product, and by being formed into the ring shape, the path guide member 81 can reliably carry the gas which is blown out of the upper communication path 85 of the partition plate 80 close to the side surface of the sealed container 50. Further, according to the path area of the path guide member 81, the speed of collision with the side surface of the sealed container 50 is determined.

Embodiment 2

Figure 4A:
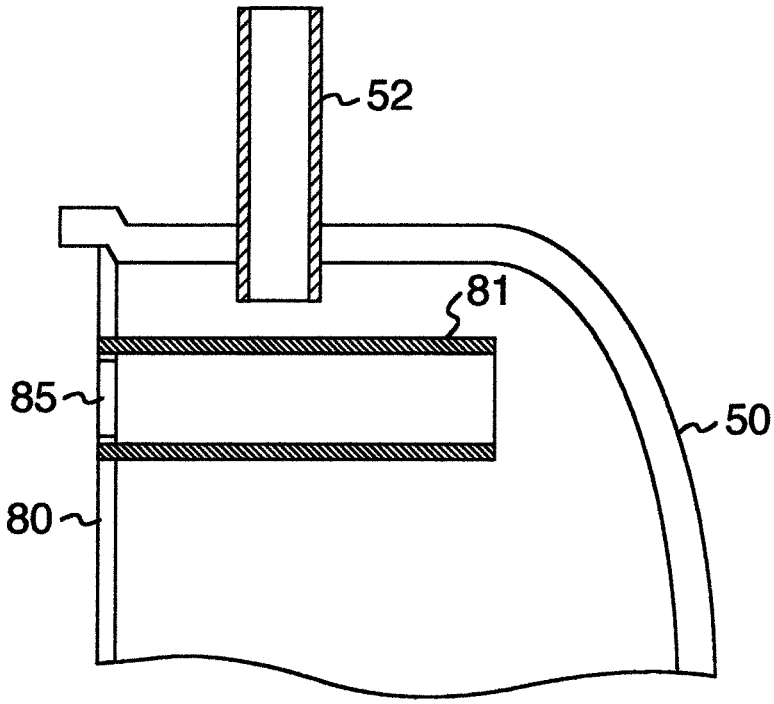
FIG. 4*a* is a vertical sectional view of an essential part of a path guide member of embodiment 2 of the present invention.
Figure 4B:
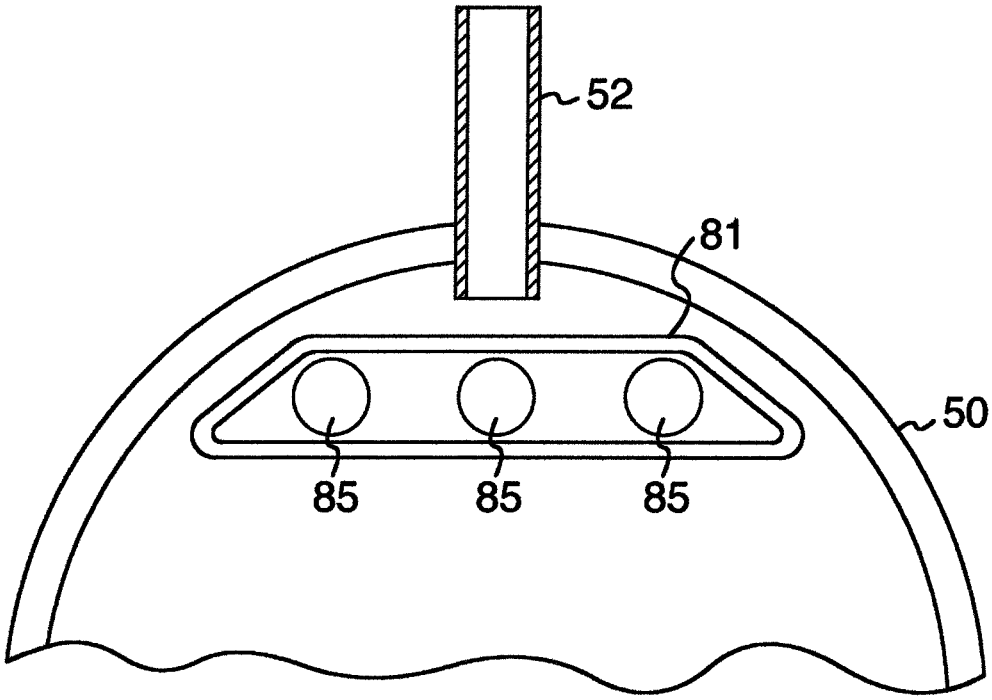
FIG. 4*b* is a cross-sectional view of the path guide member of embodiment 2 of the present invention.

FIG. 4 shows embodiment 2 of the present invention. The present embodiment is an example in which a plurality (three) of upper communication paths 85 are provided. The path guide member 81 is configured into a ring shape as in embodiment 1 to be extended close to the side surface of the sealed container, and so that the aforesaid plurality of upper communication paths 85 are disposed in the path guide member 81. With such a configuration, oil separation by collision of the refrigerant gas with the side surface of the sealed container is possible, and the oil separation effect and the effect of prevention of re-dispersion of oil can be obtained.

Embodiment 3

Figure 5A:
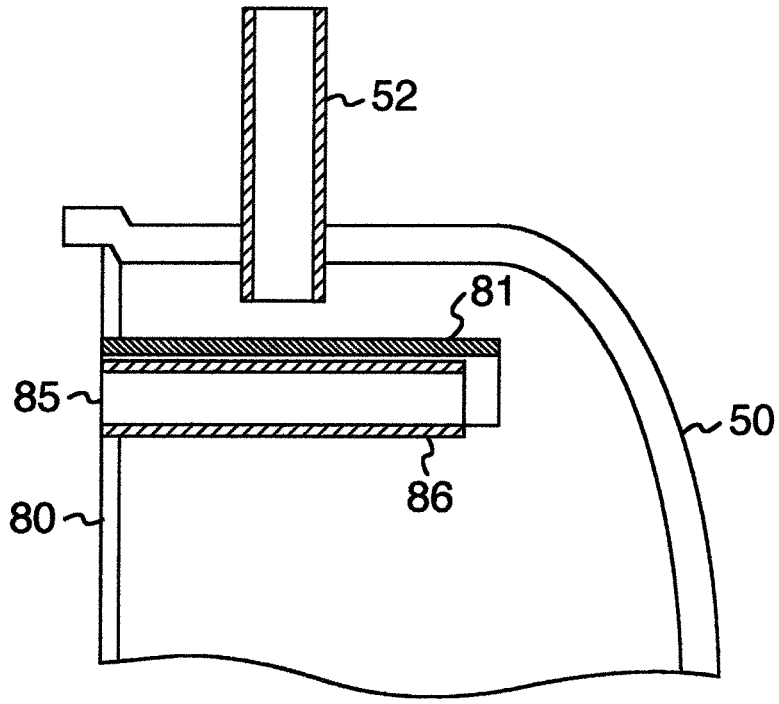
FIG. 5*a* is a vertical sectional view of an essential part of a path guide member of embodiment 3 of the present invention.
Figure 5B:
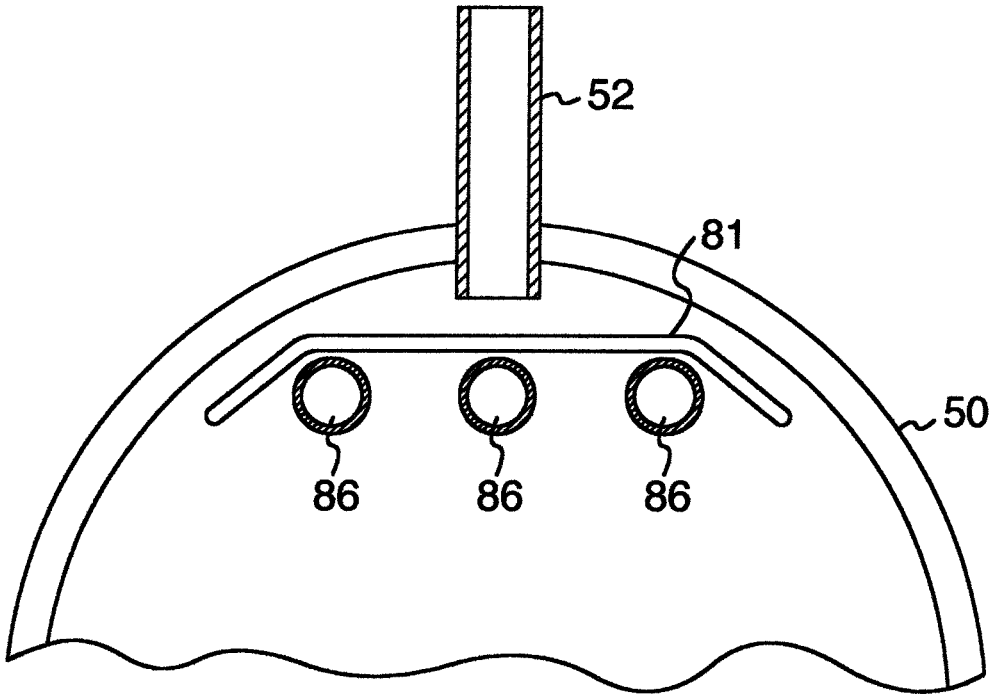
FIG. 5*b* is a cross-sectional view of the path guide member of embodiment 3 of the present invention.

FIG. 5 shows embodiment 3. The present embodiment is an example in which the upper communication path 85 formed in the partition plate 80 is formed into a hole shape, and a blow-off pipe 86 is attached to a portion of the hole. In the present embodiment, three of the upper communication paths 85 are provided, and three blow-off pipes are adopted. Further, the path guide member 81 is provided at the upper side to cover the three blow-off pipes 86, and is formed into one umbrella-shaped thin plate form. In the present embodiment, the collision speed of the gas to the side surface of the sealed container is determined by the total path area of the three blow-off pipes 86, and the blow-off pipes 86 themselves are extended close to the side surface of the sealed container. Further, the path guide member 81 which is provided above the blow-off pipes 86 is also formed into the shape extended closer to the side surface of the sealed container at the side opposite from the compressor mechanism section than the discharge pipe 52 which is attached to the sealed container 50, and thereby, the effect of preventing re-dispersion of oil can be obtained.

In the above described embodiments, the case of application to a refrigerant compressor for refrigeration or air-conditioning is described, but the present invention can be similarly applied to air and other gas compressors if only oil is included in the compressed gas.

It should be further understood by those skilled in the art that although the foregoing description has been made on embodiments of the invention, the invention is not limited thereto and various changes and modifications may be made without departing from the spirit of the invention and the scope of the appended claims.

REFERENCE SIGNS LIST

10 FIXED SCROLL
11 ORBITING SCROLL

12 ORBITING BEARING
13 OLDHAM COUPLING
14 INTAKE PORT
15 DISCHARGE PORT
20 DRIVE SHAFT
21 CRANK PIN
22 PUMP COUPLING
23 OIL PATH
30 FRAME
31 MAIN BEARING
32 AUXILIARY BEARING
33 OIL DISCHARGE PATH
40 STATOR
41 ROTOR
50 SEALED CONTAINER
51 INTAKE PIPE
52 DISCHARGE PIPE
53 OIL SUMP
60 LOWER FRAME
61 HOUSING
70 OIL SUPPLY PUMP
72 OIL SUPPLY PIPE
73 PUMP CASE
80 PARTITION PLATE
81 PATH GUIDE MEMBER
82 LOWER COMMUNICATION PATH
83 MIDDLE VOLUME
84 DISCHARGE VOLUME
85 UPPER COMMUNICATION PATH
86 BLOW-OFF PIPE

The invention claimed is:

1. A horizontal scroll compressor comprising a compressor mechanism including orbiting and fixed scrolls having respective base plates and respective spiral laps extending from the respective base plates, an electric motor for rotationally driving the compressor mechanism, and a sealed container containing therein the orbiting and fixed scrolls and the electric motor and including a discharge pipe through which a gas compressed by the compressor mechanism is discharged, wherein the horizontal scroll compressor further comprises a partition plate partitioning the sealed container into a volume containing therein the compressor mechanism and the electric motor and a discharge volume containing therein the discharge pipe and an oil supply pump for supplying oil to a bearing supporting a drive shaft for rotationally driving the compressor mechanism, an upper communication path arranged at an upper portion of the partition plate to enable the compressed gas to flow from the compressor mechanism, and a path guide member for guiding the compressed gas from the upper communication path to the vicinity of an inner side surface of the sealed container, and the path guide member is disposed below the discharge pipe, a compressed gas blow-off port end portion of the path guide member is disposed to be closer to the inner side surface in comparison with the discharge pipe, and the path guide member has an annular shape, and a flow passing area of the annular shape is larger than that of the discharge pipe.

2. The horizontal scroll compressor according to claim 1, wherein a plurality of the upper communication paths are arranged on the partition plate.

3. The horizontal scroll compressor according to claim 2, wherein the path guide member has an annular shape covering the plurality of the upper communication paths.

4. The horizontal scroll compressor according to claim 1, wherein a blow-off pipe extends in an axial direction to be connected to the upper communication path formed on the partition plate and to extend to the vicinity of the inner side surface of the sealed container, and the path guide member is arranged between the blow-off pipe and the discharge pipe to have an umbrella shape.

5. The horizontal scroll compressor according to claim 4, wherein a plurality of the upper communication paths and a plurality of the blow-off pipes are provided, and a total flow passing area of the plurality of the blow-off pipes is larger than a flow passing area of the discharge pipe.

6. The horizontal scroll compressor according to claim 1, wherein the oil supply pump is a trochoid type pump.

7. A scroll compressor for compressing a gas, comprising:

a compressor mechanism including a fixed scroll and a orbiting scroll, an electric motor for driving the orbiting scroll, a sealed container including an intake port and a discharge port, and containing therein the compressor mechanism section and the electric motor section therein, so that a gas to be compressed is introduced into the sealed container from the intake port extending through the sealed container, and a compressed gas is discharged out of the sealed container from the discharge port extending through the sealed container, a partition plate dividing an inside of the sealed container into a first chamber containing therein the compressor mechanism and a second chamber fluidly communicating with the discharge port so that a gaseous pressure in the second chamber is lower than a gaseous pressure in the first chamber, and including a communication path enabling the gas to flow into the second chamber from the first chamber, and a pump for pumping a lubricant oil into the first chamber from the second chamber through the partition plate, wherein the scroll compressor further comprises a path guide member extending in the second chamber to guide a flow of the gas flowing into the second chamber from the communication path extending through the partition plate, and the whole of the discharge port and the path guide member overlap each other as seen in a direction perpendicular to a direction of the flow of the gas guided by the path guide member.

8. The scroll compressor according to claim 7, wherein the path guide member extends between the discharge port and a central axis of the flow of the gas guided by the path guide member.

9. The scroll compressor according to claim 7, wherein a difference in gaseous pressure between the first chamber and the second chamber makes a vertical height of the lubricant oil in the first chamber lower than a vertical height of the lubricant oil in the second chamber.

10. The scroll compressor according to claim 7, wherein the discharge port and the path guide member at least partially overlap each other as seen in a direction parallel to a direction of a flow of the gas flowing through the discharge port.

11. The scroll compressor according to claim 10, wherein the whole of the discharge port and the path guide member overlap each other as seen in the direction parallel to the direction of the flow of the gas flowing through the discharge port.

12. The scroll compressor according to claim 7, wherein the path guide member has a tubular shape, and the gas flows through the path guide member to be guided by the path guide member.

* * * * *